United States Patent [19]

Hopkins

[11] 4,357,928

[45] Nov. 9, 1982

[54] DRESSING DEVICE FOR SHAPING GRINDING WHEELS

[76] Inventor: Jack R. Hopkins, Wolsey Cottage, Swallowfield, Berkshire RG7 1TH, England

[21] Appl. No.: 163,845

[22] Filed: Jun. 27, 1980

[30] Foreign Application Priority Data

Jul. 2, 1979 [GB] United Kingdom ..... 7922889

[51] Int. Cl.[3] ..... B24B 53/12

[52] U.S. Cl. ..... 125/11 F

[58] Field of Search ..... 125/11 PT, 11 F, 11 R, 125/11 TP, 11 N; 51/165 TP

[56] References Cited

U.S. PATENT DOCUMENTS

| | | | |
|---|---|---|---|
| Re. 28,766 | 4/1976 | Villano | 51/165 TP |
| 1,855,343 | 4/1932 | Edgar | 125/11 F |
| 2,720,875 | 10/1955 | Hoagland | 125/11 PT |
| 2,888,005 | 5/1959 | Goeke | 125/11 N |
| 3,273,554 | 9/1966 | Bunge | 125/11 R |
| 3,411,492 | 11/1968 | Merritt | 125/11 R |
| 3,603,302 | 9/1971 | Payea | 125/11 TP |

*Primary Examiner*—Harold D. Whitehead
*Attorney, Agent, or Firm*—H. Samuel Kieser

[57] ABSTRACT

A dressing device for shaping grinding wheels for use in manufacture of gear wheels and the like, comprises an arm (4) supported intermediate its ends by a spherical bearing (5,9) for free angular movement about a fixed point (P) on the arm axis and for rotation about the axis. The working element (2) e.g. a diamond, is carried on the forward end of the arm and a control mechanism adapted for automatic electronic control is coupled to the rear end of the arm through a gimble (6,7). The control mechanism includes a pair of slide tables (17,20) having respective motors (18,21) for movement in mutually perpendicular directions (x,y) and a third motor coupled to a gear (24) fast with the arm for rotating the arm.

9 Claims, 4 Drawing Figures

DRESSING DEVICE FOR SHAPING GRINDING WHEELS

This invention relates to a dressing device for shaping grinding wheels for use especially, but not exclusively, in the manufacture of gear wheels and the like.

A known dressing device for profiling grinding wheels features a pantograph mechanism which controls movement of the working element according to the shape of a template. Typically the pantograph has a 5:1 or 10:1 reduction from the template to the working element. It is also known to provide means for rotating the working element to adjust its angle to the grinding wheel surface in order to reduce uneven wear of the working element. A drawback of the known pantographic dressing devices is that they include many bearings and linkages which are sources of inaccuracy. In addition, devices of this kind do not lend themselves to automatic, numerical control which is becoming increasingly popular in the engineering industry.

According to the present invention there is provided a dressing device for profiling grinding wheels comprising an arm supported intermediate its ends for free angular movement about a predetermined point on the longitudinal axis of the arm and for rotation through a full 360° about said axis, means at one end of the arm for supporting a working element, and control means coupled to the arm on the side of said predetermined point remote from said one end for controlling angular displacement of the arm about said predetermined point and rotation of the arm about its axis.

The device of the invention is simple insofar as it includes a single arm with one support which may take the form of a spherical bearing, a gimble mechanism, an anti-friction ball or roller type bearing, or other device permitting the necessary arm movement. The control means can be located at a position remote from the working element, which can be of considerable advantage when the device is mounted on a gear grinding machine where space in the vicinity of the grinding wheel is limited and preferably kept clear. The pivotal and rotary motions of the arm are easily controlled enabling grinding wheels with widely varying shapes to be profiled accurately. Furthermore, the control means may be conveniently adapted for automatic, electronic control.

In one embodiment of the invention the control means is mounted for rectilinear movement in two mutually perpendicular directions and coupled to the arm through a gimble mechanism.

The intermediate support for the arm may be located medially between the control means and the working element or it may be positioned nearer the working element to provide a reduction in the working element displacement compared with that produced by the control means.

The present invention also provides a holder for a working element, in particular a diamond, suitable for use in the dressing device, comprising a support, a holder carried on the support and adjustable relative to the support in a predetermined plane, a bushing receivable in the holder and having a bore for receiving the working element or number of elements, in particular diamonds with the axis of the element normal to the predetermined plane, the element being axially adjustable relative to the bushing and lockable in an adjusted position.

A holder of this forms allows the tip of the diamond to be set precisely in an optimum position. The bushing is preferably rotatable in its holder and lockable in an adjusted angular position so that the diamond can be selectively rotated about its axis for equalizing wear to maintain the tip on the diamond and extend its useful lifetime. A further advantage of the holder is that it assists accurate optical setting which in turn prolongs diamond life, and allows the addition of a roughing diamond clamped in a suitable block set at a slightly greater distance from the pivot point than the accurately set diamond. This latter feature also prolongs the life of the finishing diamond and makes it unnecessary to alter the control input, which is of particular importance when shaping a new grinding wheel.

A more complete understanding of the invention will be had from the following detailed description which is given by way of example with reference to the accompanying drawings, in which.

Figure 1:
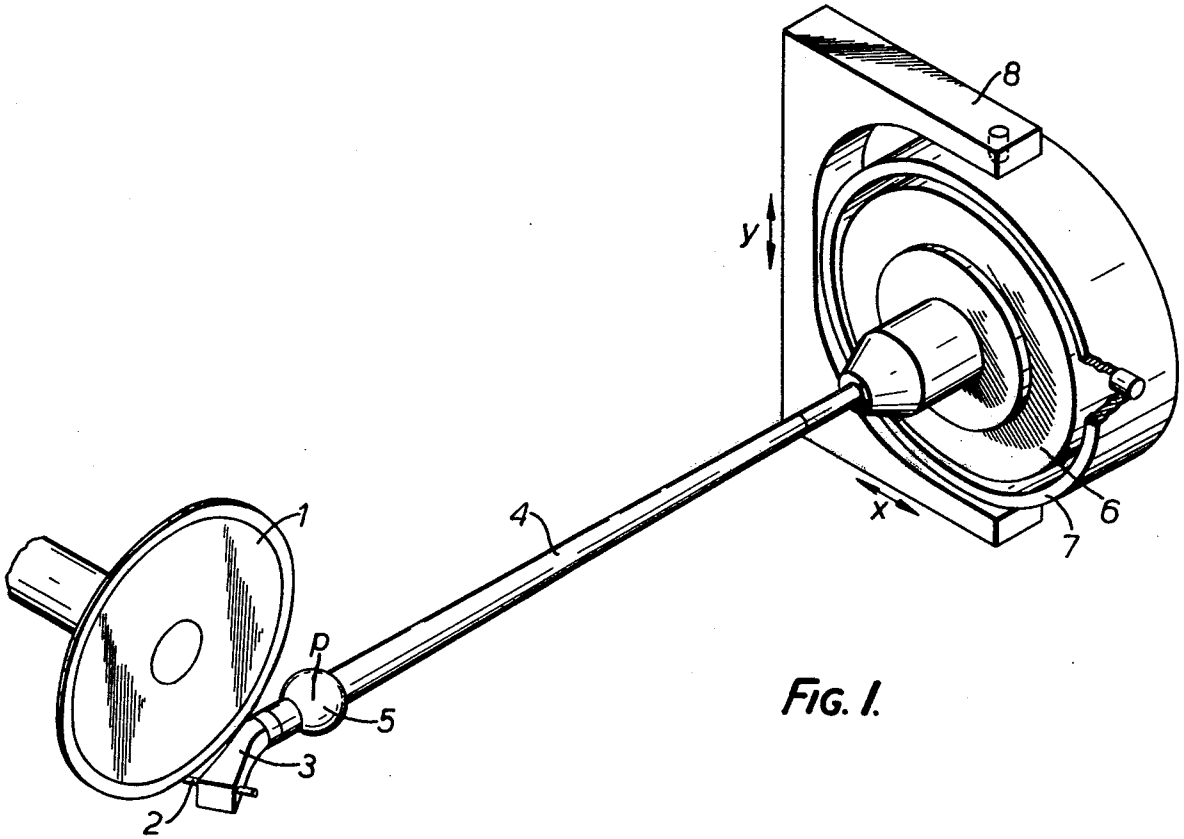
FIG. 1 is a schematic perspective view illustrating the principles underlying the invention.

Referring initially to FIG. 1, the dressing device for profiling the grinding wheel 1 of a gear grinding machine (not shown) includes a working element 2 of diamond or other suitable hard material supported by a mounting member 3 attached to the front end of a control arm consisting of a rod 4. The rod is fitted with a ball 5 of a spherical bearing near the front end, the centre of the ball being fixed in a predetermined position along the rod axis and defining a point P about which the rod can pivot in any direction. The rear end of the rod 4 is connected to the inner member 6 of a gimble 6,7 which couples the rod to a yoke 8 which is mounted by means not shown for movement in two mutually perpendicular directions indicated by arrows x and y. The rod is capable of axial movement and rotation relative to the gimble member 6.

As the point P is fixed, movement of the yoke 8 in the x and y directions is reflected by similar movements of the tip D of the diamond 2, the tip D is adjusted to lie on the projected axis of the rod 4 so that rotation of the rod merely alters the angle of the diamond to the profile of the grinding wheel. It is usual for the diamond to be adjusted to be normal to the profile at all instances, but this is not always the case. It is also possible for the tip D to be off-set from the rod axis so that when the rod is turned about its axis the tip D describes an arc for producing an approximate radius.

To profile the grinding wheel 1 with the dressing device, the grinding operation is interrupted and the grinding wheel under the control of the grinding machine is presented to the dressing device. Preprogrammed electronic control means associated with the dressing device sets the diamond tip to a "homing" point and the profiling process is commenced. The diamond tip passes around the periphery of the grinding wheel 1 which continues to rotate, the movement of the diamond 2 being determined by displacement of the yoke 8 in the x and y directions and rotation of the rod 4 about is axis, these motions being under numerical control as set by the programme. The order in which the side and edge surfaces of the grinding wheel are shaped is unimportant and the diamond may, for example, make a single sweep around the periphery. Alternatively, the two sides may be shaped by distinct passes of the diamond from an inner to the outer diameter. In the latter case it may be possible to allow for a separate adjustment of the yoke in the x-direction between the two passes whereby the same control programme can be used for grinding wheels having the same shape but different thicknesses.

For some profiles it is possible to arrange one of the axes, y say, to be preset substantially parallel to the profile, and for a constant feed along this present axis while the required changes in profile are obtained by controlling the feed in the direction of a second axis, such as x, at a convenient angle to the y axis. In this particular case there may not be any need to rotate the control arm during the dressing process.

Figure 2:
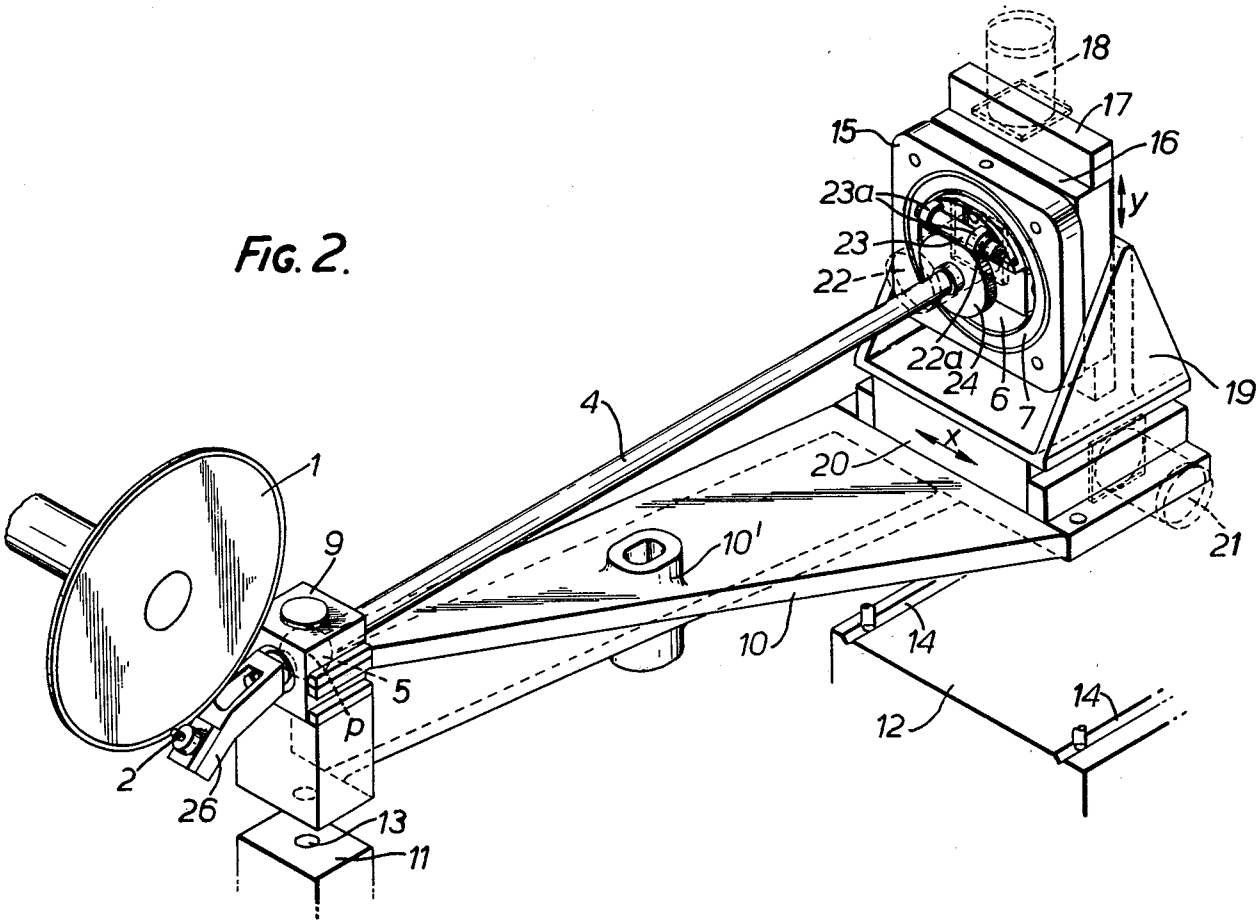
FIG. 2 is a perspective view of an exemplary dressing device according to the invention.
Figure 4:
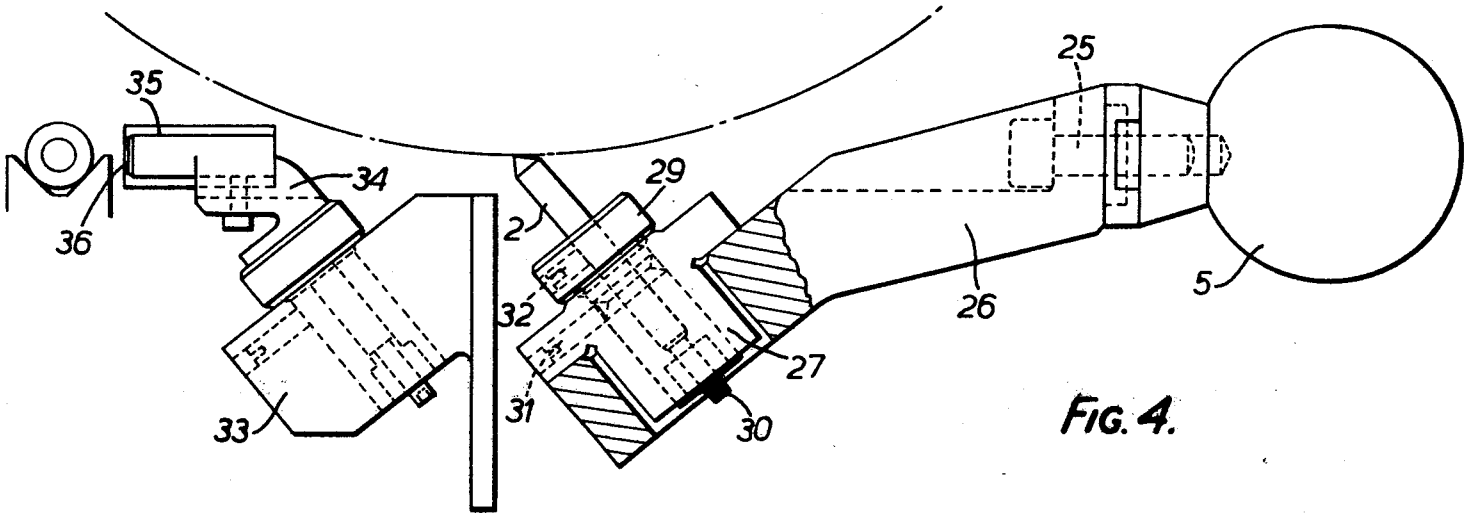
FIGS. 3 and 4 show in plan and side elevation, respectively, a diamond holder embodying the invention.
Figure 3:
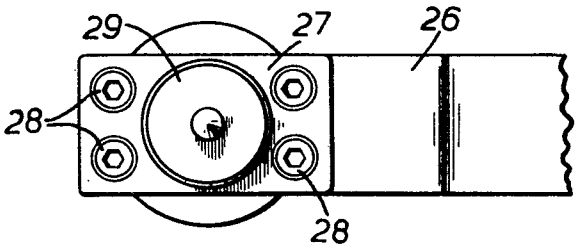

Turning now to the embodiment of FIGS. 2 to 4, the dressing device includes a control arm 4 with a ball 5, as described above. The ball is mounted in a spherical bearing block 9 fixed on a base plate 10 which also carries the control means (described in detail below) for the control arm and which is in turn carried on supporting members 11,12 having a socket 13 and grooves 14, respectively, forming a three point support system which allows the device to be conveniently adjusted in position with respect to the grinding wheel 1 to be dressed. The base plate is fixed in position by means of a bolt passed through a boss 10' provided on the base plate 10.

The control means includes a frame 15 which is coupled to the control arm 4 through a gimble 6,7 and is fixed to a slide table 16 which is movable in the direction of arrows y relative to a guide 17 under the control of a motor 18. The guide 17 is fixed to a shoe 19 which in turn is fixedly mounted on the table 20 of a second slide arranged for movement in the direction of arrows x relative to the base plate 10 under the control of a motor 21. A third motor 22 is provided for rotating the control arm 4 about its axis, a worm gear on the motor shaft driving a helical gear **22*a* which is keyed to be solid on shaft worm 23 which meshes with a spur gear 24 fast with the control arm 4. The worm 23 is journaled in bearings 23*a* carried on the gimble member 6** in which the end of the control arm is supported by a rotary/linear bearing.

The diamond working element 2 is mounted on the control arm 4 by a holder fastened to the end of the rod by a screw 25. The holder consists of a support member 26 with a downwardly inclined portion having a socket for receiving a holder 27 which has a flange clamped to the member 26 by set screws 28. The screws 28 permit slight adjustment of bush holder in the plane normal to its axis. An axial bore is provided in the holder for receiving bushing 29 which has an axial bore for receiving the diamond 2 and a screw 30 for adjusting the position of the diamond axially of the bush. Grub screws 31 and 32 are provided in the holder and bushing, respectively for fixing the bush and diamond in their adjusted positions.

To set the tip of the diamond 2 in line with the axis of the control rod 4 an optical projection including a suitable bracket 33 to hold the bush 29 is used.

A setting piece 34 mounting a precision tube 35 is inserted in bushing 29 in place of the diamond. With the use of a precision dial indicator contacting the periphery of the tube 35, control arm 4 is rotated and adjustments made to bush holder 27, rotation of setting piece 34, and axial adjusting screw 30. When the dial indicator movement is very small as required screws 28, 32 and 31 are clamped for final inspection. Screw 31 is released and the bushing 29 carrying setting piece 34 is mounted on suitable optical projection. The precision tube 35 is aligned with the optical axis and the tube bore set in focus. A suitable master drawing is oriented accurately to the optical image of the bore. Without movement of the drawing or suitable bracket 33, setting screw 32 is released and the setting piece 34 removed from the bushing 29. The diamond 2 is then inserted and adjusted by rotation and screw 30 to the required position by optical projection and as required on the master drawing. The diamond 2 clamped by screw 32 in bushing 29 is removed from bracket 33 and inserted in holder 27 and clamped by screw 31 which also holds the flange of bush 29 firmly against the datum surface of the holder 27.

The diamond is now accurately set in an optimum position with its tip aligned with the axis of control rod 4 and the dressing device is ready for operation.

The manner in which the device is operated for profiling the grinding wheel 1 will be understood from the description given with reference to FIG. 1, the pivoting and rotation of the control arm 4 being effected through the motors 18,20,22 which are connected to a programmed electronic control device. It will be noted that the control means for the rod 4 are at a location remote from the grinding wheel and work area of the grinding machine.

From time-to-time, due to diamond wear, it is necessary to advance the diamond by means of the adjustment screw 30 to relocate its tip on the projected axis of the control rod. It is also advantageous to rotate the diamond slightly from time-to-time, for example by rotating the bushing 29 in its holder 27, in order to equalize wear on the diamond so that it is used to maximum effect and its life time enhanced. In the embodiment of FIGS. 2 to 4 the diamond axis is at 45° to the tangent to the grinding wheel at the point of contact so that the diamond will be self-sharpening. Other orientations are possible without departing from the invention.

In a modified device according to the present invention the control arm is shouldered and carries a diamond holder in the form of a bushing which holds two or more dismonds set radially with their tips at different radii, the arm being rotatable through a full 360°. In this case the control mechanism adjusts the diamond position according to the x and y coordinates while rotation of the arm serves to change the diamond occupying the effective working position as well as to adjust its angle to the grinding wheel surface. Thus, the control mechanism can operate so that the arm revolves a preset amount using a first diamond, the arm is repositioned by altering the x and y coordinates and rotated to bring a second diamond into the working position, and then the arm is revolved with the second diamond acting on the grinding wheel. In this way composite curves made up of several different radii, as commonly required on grinding wheels, can be produced without difficulty. In practice an involute curve as frequently used in gear manufacture can be made very precisely with just two radii.

Other modifications are possible and will occur to those skilled in the art. An hydraulic spherical bearing has been found especially convenient and effective in controlling the arm. Where the arm has a substantial unsupported length between the spherical bearing and the control mechanism it is advantageous to make the arm of carbon fibre material which has high rigidity but low weight so that lateral deflections of the unsupported length, which cause wobble of the working element, are minimised.

What is claimed is:

1. A dressing device for profiling grinding wheels, comprising an arm with front and rear ends, and a longitudinal axis, bearing means supporting said arm intermediate said front and rear ends thereof for free angular movement of the arm about a predetermined fixed point on said longitudinal axis and for rotation about said axis, means carried on said arm at said front end thereof for supporting a working element, and control means coupled to said arm rearwardly of said predetermined fixed point for controlling angular displacement of the arm about said fixed point and rotation of said arm about said longitudinal axis, said control means comprising means for rectilinear movement in two mutually perpendicular directions in a plane substantially normal to said axis of the arm.

2. The dressing device of claim 1, wherein the control means is spaced from said fixed point at a greater axial distance than the working element is spaced from said fixed point.

3. The dressing device of claim 1, wherein said bearing means comprises a spherical bearing.

4. The dressing device of claim 1, wherein said means comprises two slide tables having respective motors for causing movement in said two directions, respectively.

5. The dressing device according to claim 4, wherein the control means is coupled to the arm by a gimble mechanism.

6. The dressing device according to claim 5, wherein the gimble mechanism includes a part engaging the arm through a rotary/linear bearing, the arm has a gear fast therewith and said gimble part carries an electric motor coupled kinematically to said gear for rotating the arm about the axis thereof.

7. The dressing device of claim 1, wherein said means for supporting a working element comprises a member fastened to said front end of the arm, a holder secured to said member and adjustable relative thereto in a predetermined plane, a bushing received in the holder and having a bore for receiving the working element, and means for adjusting the position of the working element along the bore of the bushing.

8. The dressing device of claim 7, wherein the bushing is rotatable in the holder and the bush holder is provided with releasable means for locking the bushing in the adjusted angular position thereof.

9. The dressing device of claim 1, wherein the arm is made of carbon fibre material.

* * * * *